US008354796B2

(12) United States Patent
Yang

(10) Patent No.: US 8,354,796 B2
(45) Date of Patent: Jan. 15, 2013

(54) REVERSE POLARITY SERIES TYPE LED AND DRIVE CIRCUIT

(76) Inventor: Tai-Her Yang, Dzan-Hwa (TW)

( * ) Notice: Subject to any disclaimer, the term of this patent is extended or adjusted under 35 U.S.C. 154(b) by 575 days.

(21) Appl. No.: 12/548,610

(22) Filed: Aug. 27, 2009

(65) Prior Publication Data

US 2011/0050109 A1 Mar. 3, 2011

(51) Int. Cl.
*H05B 37/00* (2006.01)

(52) U.S. Cl. ..... 315/185 R; 315/185 S; 315/201

(58) Field of Classification Search ..... 315/291, 315/299, 360, 185 R, 192, 200 R, 312, 187, 315/205, 246, 207, 206, 200 A, 324; 362/227, 362/230, 231, 234, 235, 236, 237, 240, 252, 362/569, 810, 807, 812, 808
See application file for complete search history.

(56) References Cited

U.S. PATENT DOCUMENTS 5,688,042 A * 11/1997 Madadi et al. ..... 362/240
5,726,535 A * 3/1998 Yan ..... 315/185 R
5,806,965 A * 9/1998 Deese ..... 362/249.04
6,461,019 B1 * 10/2002 Allen ..... 362/249.06
7,250,730 B1 * 7/2007 Allen ..... 315/185 R
7,276,858 B2 * 10/2007 Allen ..... 315/205
2007/0063657 A1 * 3/2007 Wu ..... 315/205
2008/0157686 A1 * 7/2008 Chung et al. ..... 315/185 S
2009/0224688 A1 * 9/2009 Yang ..... 315/291

* cited by examiner

*Primary Examiner* — Shawki Ismail
*Assistant Examiner* — Christopher Lo
(74) *Attorney, Agent, or Firm* — Bacon&Thomas, PLLC

(57) ABSTRACT

The present invention of a reverse polarity series type LED is formed by two sets of LED and diode assemblies in reverse polarity series connection wherein the first set is consisted of at least one or multiple homopolar series or parallel connected or series and parallel connected LED's, and the second set consisting of at least one or more homopolar parallel or series connected or series and parallel connected LED's for further connection to the drive circuit formed by current-limiting impedance and/or power storage and discharging devices and/or voltage-limit circuit devices in order to produce the required operational characteristics.

13 Claims, 3 Drawing Sheets

REVERSE POLARITY SERIES TYPE LED AND DRIVE CIRCUIT

BACKGROUND OF THE INVENTION (a) Field of the Invention

The present invention relates to a reverse polarity series type LED and drive circuit that feature the use of direct current or alternating current power source by means of the selection of pins.

(b) Description of the Prior Art

Currently LED's are divided into direct current electric energy drive and alternating current LED which is driven by alternating current through reverse polarity parallel connection of LED's. Their usages are relatively inflexible.

SUMMARY OF THE INVENTION

The present invention of a reverse polarity series type LED is formed by two sets of LED and diode assemblies in reverse polarity series connection wherein the first set is consisted of at least one or multiple homopolar series or parallel connected or series and parallel connected LED's, and the second set consisting of at least one or more homopolar parallel or series connected or series and parallel connected LED's for further connection to the drive circuit formed by current-limiting impedance and/or power storage and discharging devices and/or voltage-limit circuit devices in order to produce the required operational characteristics.

DESCRIPTION OF MAIN COMPONENT SYMBOLS (101), (102): LED
(201), (202): Diodes
(301), (302): Power storing and discharging devices
(400), (401), (402): Current-limiting impedance elements
(501), (502): Voltage-limiting elements
a terminal: Independent terminal of the first LED and diode assembly connection
b terminal: Reverse series connection terminal of the first and second LED and diode assemblies
c terminal: Independent terminal of the second LED and diode assembly connection

DETAILED DESCRIPTION OF THE PREFERRED EMBODIMENTS

Currently LED's are divided into direct current electric energy drive and alternating current LED which is driven by alternating current through reverse polarity parallel connection of LED's. Their usages are relatively inflexible.

The present invention relates to a reverse polarity series type LED and drive circuit that feature the use of direct current or alternating current power source by means of the selection of pins.

The present invention of a reverse polarity series type LED is formed by two sets of LED and diode assemblies in reverse polarity series connection wherein the first set is consisted of at least one or multiple homopolar series or parallel connected or series and parallel connected LED's, and the second set consisting of at least one or more homopolar parallel or series connected or series and parallel connected LED's for further connection to the drive circuit formed by current-limiting impedance and/or power storage and discharging devices and/or voltage-limit circuit devices in order to produce the required operational characteristics.

Figure 1:
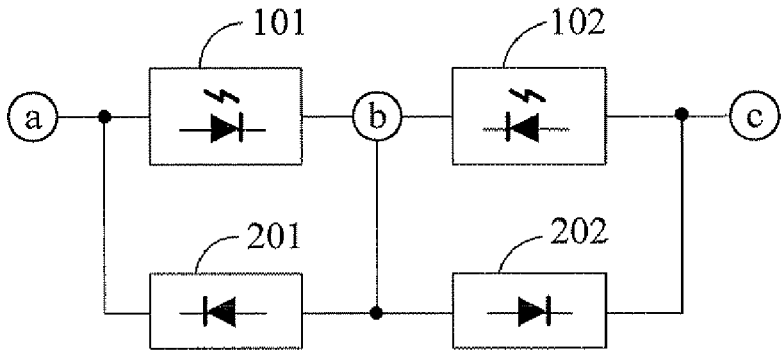
FIG. 1 is the circuit diagram of the reverse polarity series type LED of the present invention

The main formation of the reverse polarity series type LED and drive circuit are the following:

FIG. 1 is the circuit structural diagram of the reverse polarity series LED of the present invention;

The main formation of FIG. 1 includes:

LED (101): Formed by one or more luminous diodes in homopolar parallel or series connection or in series and parallel connection.

LED (102): Formed by one or more luminous diodes in homopolar parallel or series connection or in series and parallel connection.

Diodes (201), (202): Formed by one or more rectified diode or single way conductive circuit devices in parallel or series connection or in series and parallel connection By means of parallel connection between the LED (101) and the diode (201) in the reciprocal turn-on current direction, the first set of LED and diode assembly is formed. And by means of the parallel connection between the LED (102) and the Diode (202) in the reciprocal turn-on current direction, the second LED and diode assembly is formed.

By means of the reverse polarity series connection between the first LED and diode assembly with the second LED and diode assembly, a reverse polarity series type LED device is formed; wherein the independent connection terminal of the first LED and diode assembly is designated as the (a) terminal, and the reverse polarity series connection terminal between the first and the second LED and diode assemblies is designated as the (b) terminal. The independent connection terminal of the second LED and diode assembly is designated as the (c) terminal.

Figure 2:
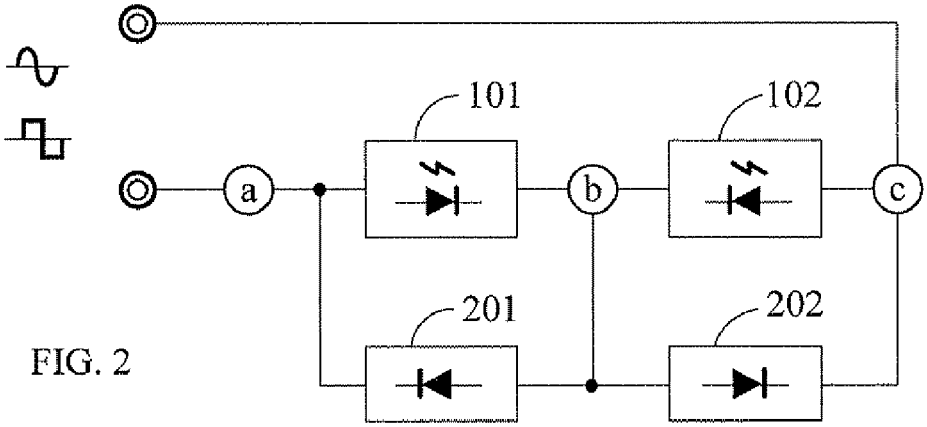
FIG. 2 is the circuit diagram of the present invention as applied on the alternating current power source and connected in series with the impedance elements
Figure 3:
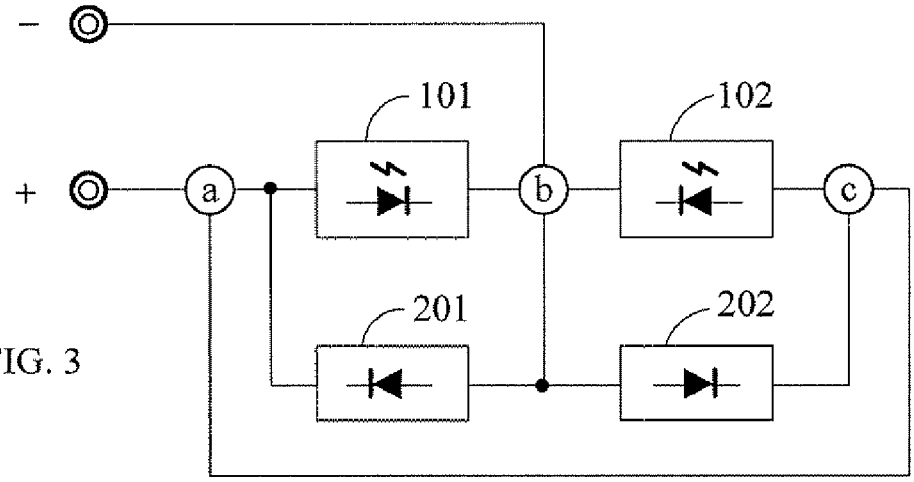
FIG. 3 is the circuit diagram of the reverse polarity series type LED as applied on the direct current power source

When alternating current power is delivered from the (a) and (c) terminals of the reverse polarity series type LED, the reverse polarity series type LED device serves to perform the functions of the alternating current LED. FIG. 2 shows the circuit diagram of the reverse polarity series type LED as applied on alternating current power; or When the (a) and (c) terminals of the reverse polarity series type LED are connected to each other, their connection terminal and (b) terminal serve to commonly allow direct current to pass through LED (101) and LED (102) so that the reverse polarity series type LED device serves to perform the functions of a direct current LED. FIG. 3 shows the circuit diagram of the reverse polarity series type LED as applied on the direct current power.

When the reverse polarity series type LED and drive circuit are applied on the alternating current power, a current-limiting impedance element (400) is series connected to the (a) or (c) terminals of the alternating current power and the reverse polarity series type LED and/or a current-limiting impedance element (401) is series connected to LED (101) and/or a current-limiting impedance element (402) is series connected to the LED (102).

Figure 4:
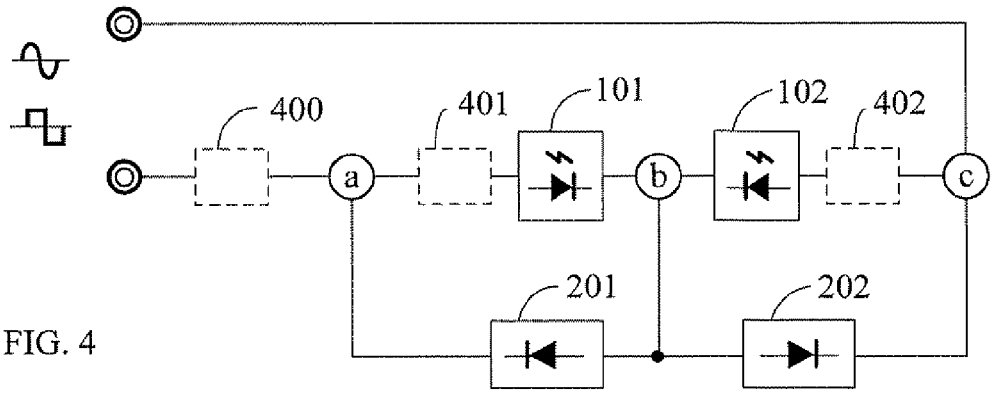
FIG. 4 is the circuit diagram of the reverse polarity series type LED as applied on the alternating current power source and connected in series with the impedance elements

FIG. 4 is the circuit diagram of the reverse polarity series type LED of the present invention being applied on alternating current power and series-connected with impedance elements;

As shown in FIG. 4, the impedance elements are formed by one or more impedance element types including: 1) resistive impedance element 2) conductive impedance elements 3) inductive impedance elements 4) linear transistor impedance elements 5) clipping on-off type elements formed by solid on-off type elements 6) thyristor clipping on-off elements The series positions of the impedance elements include: 1) the impedance element is connected in series with individual LED afterwhich it connects in parallel with diodes; and/or 2) the impedance element is connected in series between the power source and the reverse polarity series type LED; and/or 3) the LED connects to the diode in parallel and then connects to the impedance element in series.

When the reverse polarity series type LED and drive circuit are applied on the direct current power, a current-limiting impedance element (400) is series-connected with the connection terminal of the direct current power and the reverse polarity series type LED (a) and (c) terminals or with (b) terminal and/or a current-limiting impedance element (401) is series-connected to the LED (101) and/or a current-limiting impedance element (402) is series connected to the LED (102).

Figure 5:
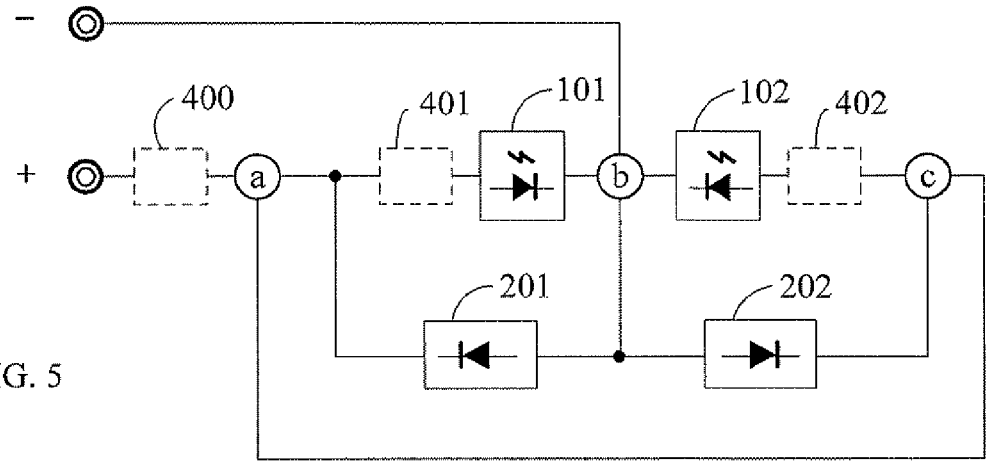
FIG. 5 is the circuit diagram of the reverse polarity series type Led of the present invention as applied on the direct current power source and connected in series with impedance elements

FIG. 5 is a circuit diagram of the reverse polarity series type LED being applied on the direct current power source and its connection in series with an impedance element;

As shown in FIG. 5, the impedance elements formed by one or more impedance element types including: 1) resistive impedance element 2) linear transistor impedance elements 3) clipping on-off type elements formed by solid on-off type elements 4) thyristor clipping on-off elements The series positions of the impedance elements include: 1) the impedance element is connected in series with individual LED afterwhich it connects in parallel with diodes; and/or 2) the impedance element is connected in series between the power source and the reverse polarity series type LED; and/or 3) the LED connects to the diode in parallel and then connects to the impedance element in series.

Figure 6:
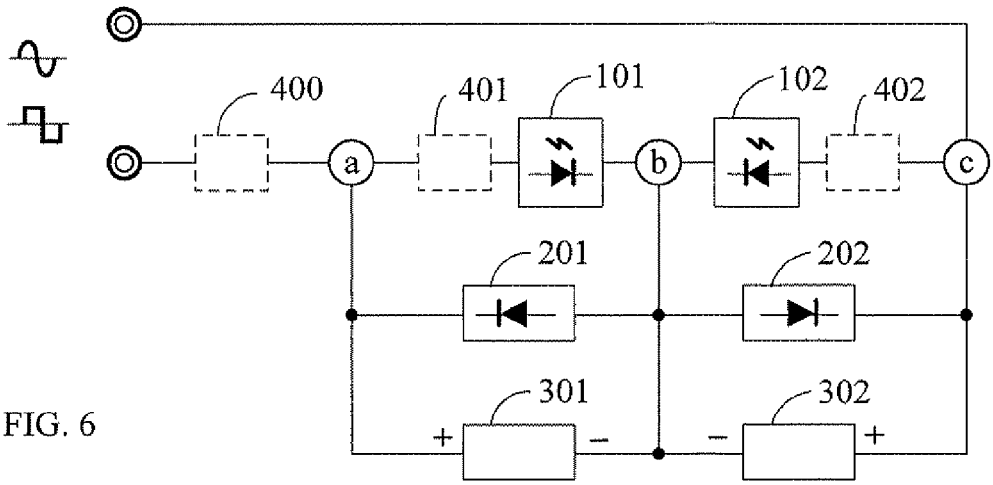
FIG. 6 is the circuit diagram of the reverse polarity series type LED of the present invention as applied on the alternating current power source and connected in series with the current-limiting impedance element and in parallel with the power storing and discharging device
Figure 7:
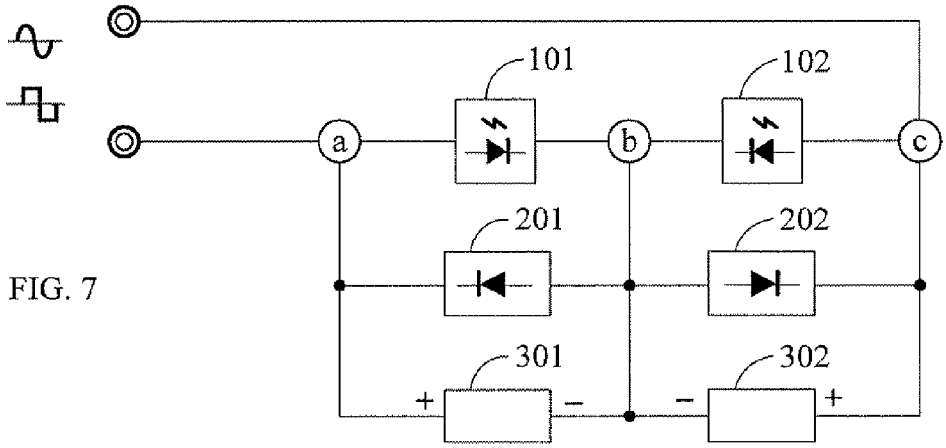
FIG. 7 is the circuit diagram of the reverse polarity series type LED as applied on the alternating current power source and connected in parallel with the power storing and discharging devices

When the reverse polarity series type LED and drive circuit are applied on the alternating current power, a current-limiting impedance element (400) is series connected to the (a) or (c) terminals of the alternating current power and the reverse polarity series type LED and/or a current-limiting impedance element (401) is series connected to LED (101) and/or a current-limiting impedance element (402) is series connected to the LED (102), and power storing and discharging device (301) and/or power storing and discharging device (302) is/are parallel-connected with the two ends of the diode (201) and/or diode (202). Their polarities during the delivery of alternating current power are such that they assume a power supply status with respect to the LED with which they are connected in parallel. When the power supply voltage is higher than the voltage of its parallel-connected power storing and discharging device, the power source simultaneously supplies power to the LED and charges the power storing and discharging device with which it is connected in parallel. The polarities of the alternating current power supply do not supply power to its parallel-connected LED. When the power supply voltage is lower than the voltage of the power storing and discharging device, the power storing and discharging device will supply power to the LED with which it is connected in parallel. By means of the operation of the power storing and discharging device, the following partial or complete functions are attained: 1) enables two LED's to deliver power and emit light without being affected by the polarity changes of the alternating current power source. 2) when alternating current power is driving the LED, optical pulsation of the LED is reduced 3) supplies delay electric energy for LED when power is cut off 4) serves as power supply to allow continuous lighting of LED's during an emergency power shutdown. The power storing and discharging device is consisted of a rechargeable battery or a monopolar or bipolar capacitance or super capacitance; FIG. 6 is the circuit diagram of the reverse polarity series type LED as applied on alternating current power with the additional installation of current-limiting impedance elements and connected in parallel with power storing and discharging device;

In the operational view of FIG. 6 wherein the reverse polarity series type LED is applied on the alternating current power and parallel-connected to the power storing and discharging device, the current-limiting impedance element (400) and/or the current-limiting impedance element (401) and/or the current-limiting impedance element (402) is/are optionally installed. FIG. 7 is the circuit diagram of the reverse polarity series type LED of the present invention as applied on alternating current power and connected in parallel with the power storing and discharging device.

Figure 8:
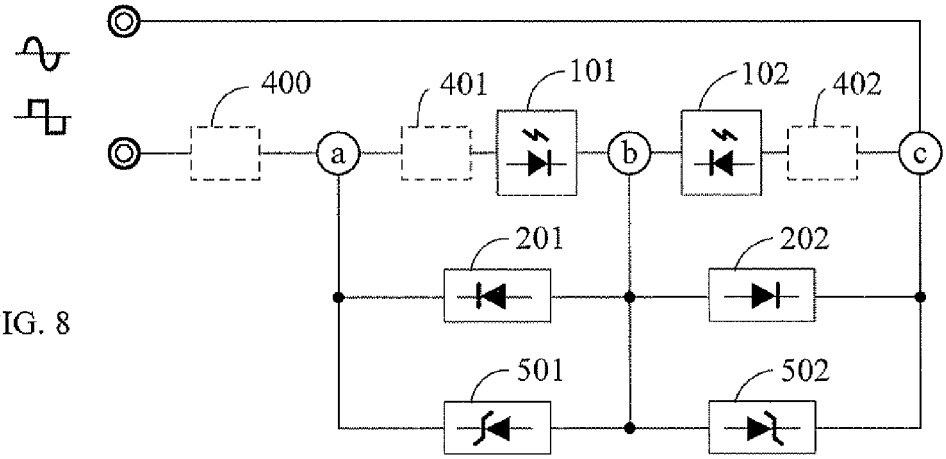
FIG. 8 is the circuit diagram of the reverse polarity series type LED of the present invention as applied on the alternating current power source and connected in parallel with the voltage-limiting elements and in series with the impedance elements
Figure 9:
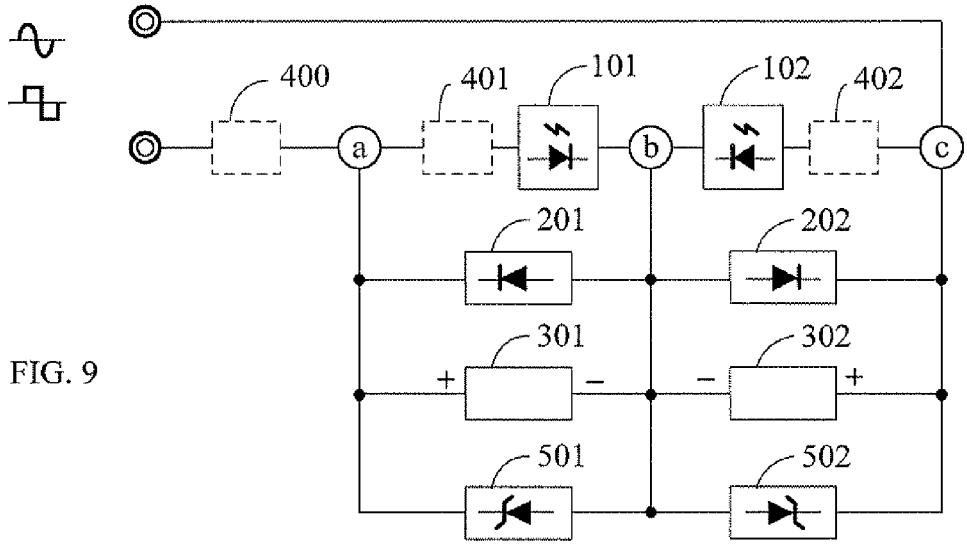
FIG. 9 is the circuit diagram of the reverse polarity series type Led of the present invention as applied on the alternating current power source and connected in parallel with the voltage-limiting elements and the power storing and discharging devices and in series with the impedance elements

When the reverse polarity series type LED and drive circuit are applied on the alternating current power, a voltage-limiting element (501) and/or voltage-limiting element (502) is/are connected in parallel to both ends of diode (201) and/or diode (202) to form a voltage-limiting protection for the LED in conjunction with the installation of current-limiting impedance element (400) and/or current-limiting impedance element (401) and/or current-limiting impedance element (402). The voltage-limiting elements are consisted of zener diodes or electromechanical and electronic circuit devices with zener effects. FIG. 8 is the circuit diagram of the reverse polarity series type Led as applied on alternating current power and connected in parallel with voltage-limiting elements and in series with impedance elements.

The reverse polarity series type LED and drive circuit can further connect the two ends of the first LED and diode assembly and/or the second LED and diode assembly in parallel with the power storing and discharging device (301) and/or the power storing and discharging device (302), and to also to connect them in parallel with voltage-limiting element (501) and/or voltage-limiting element (502). Furthermore, protection for the LED and power storing and discharging device is provided in conjunction with the installation of current-limiting element (400) and/or current-limiting element (401) and/or current-limiting element (402). Pertinent functions are shown in FIG. 4 to FIG. 7, FIG. 9 is the circuit diagram of the reverse polarity series type LED as applied on the alternating current power and connected in parallel with the voltage-limiting elements and the power storing and discharging devices and in series with impedance elements.

During actual applications, pertinent elements of the reverse polarity series type LED and drive circuit have the following options:

1) The specifications for power, voltages, currents and numbers as well as the series or parallel or series-parallel connections of LED (101) and LED (102) are the same with or different from each other;
2) The colors of lights emitted by the energized LED (101) and LED (102) are the same with or different from each other;
3) The types and specifications of the current-limiting element (400) and/or current-limiting element (401) and/or current-limiting element (402) are the same with or different from each other;
4) The current-limiting impedance element (400) and/or the current-limiting impedance element (401) and/or the current-limiting impedance (402) is/are fixed impedances and adjustable impedance values or clipping controlled or linear controlled in order to control LED light adjustments. This includes simultaneous or separate control of LED (101) and LED (102);
5) The types and specifications of the power storing and discharging device (301) and/or power storing and discharging device (302) are the same with or different from each other;
6) The types and specifications of the voltage-limiting element (501) and voltage-limiting element (502) are the same with or different from each other.

The invention claimed is:

1. A reverse polarity series type LED is formed by two sets of LED and diode assemblies in reverse polarity series connection wherein a first set consists of at least one or multiple homopolar series or parallel connected or series and parallel connected LEDs, and a second set consists of at least one or more homopolar parallel or series connected or series and parallel connected LEDs for further connection to the drive circuit formed by current-limiting impedance and/or power storage and discharging devices and/or voltage-limit circuit devices in order to produce required operational characteristics, its main formation consisting of:

a LED (101): formed by one or more luminous diodes in homopolar parallel or series connection or in series and parallel connection, a LED (102): formed by one or more luminous diodes in homopolar parallel or series connection or in series and parallel connection, and diodes (201), (202): formed by one or more rectified diode or single way conductive circuit devices in parallel or series connection or in series and parallel connection, wherein:

by means of parallel connection between the LED (101) and the diode (201) in a reciprocal turn-on current direction, the first set of LED and diode assembly is formed, by means of the parallel connection between the LED (102) and the diode (202) in the reciprocal turn-on current direction, the second LED and diode assembly is formed;

by means of a reverse polarity series connection between the first LED and diode assembly with the second LED and diode assembly, a reverse polarity series type LED device is formed; wherein an independent connection terminal of the first LED and diode assembly is designated as the (a) terminal, the reverse polarity series connection terminal between the first and the second LED and diode assemblies is designated as the (b) terminal, and the independent connection terminal of the second LED and diode assembly is designated as the (c) terminal;

a current-limiting impedance element (400) is series-connected to the (a) or (c) terminals and the reverse polarity series type LED and/or a current-limiting impedance element (401) is series connected to LED (101) and/or a current-limiting impedance element (402) is series-connected to the LED (102); wherein the impedance elements are formed by one or more impedance element types including: 1) resistive impedance element 2) conductive impedance elements 3) inductive impedance elements 4) linear transistor impedance elements 5) clipping on-off type elements formed by solid on-off type elements 6) thyristor clipping on-off elements; and the series positions of the impedance elements include: 1) the impedance element is connected in series with individual LEDs after which the impedance element is connected in parallel with diodes; and/or 2) the impedance element is connected in series between the power source and the reverse polarity series type LED; and/or 3) the LED connects to the diode in parallel and then connects to the impedance element in series.

2. The reverse polarity series type LED and drive circuit as claimed in claim 1, wherein alternating current power is delivered from the (a) and (c) terminals of the reverse polarity series type LED, the reverse polarity series type LED device serves to perform the functions of the alternating current LED.

3. The reverse polarity series type LED and drive circuit as claimed in claim 1, wherein the (a) and (c) terminals of the reverse polarity series type LED are connected to each other, their connection terminal and (b) terminal serve to commonly allow direct current to pass through LED (101) and LED (102) so that the reverse polarity series type LED device serves to perform the functions of a direct current LED.

4. The reverse polarity series type LED and drive circuit as claimed in claim 1, wherein the (a) and (c) terminals are alternating current power terminals.

5. The reverse polarity series type LED and drive circuit as claimed in claim 1 wherein the (a) and/or (c) terminals are direct current power positive terminals and the (b) terminal is a direct current power negative terminal.

6. The reverse polarity series type LED and drive circuit as claimed in claim 2 applied to alternating current power, wherein a current-limiting impedance element (400) is further series-connected to the (a) or (c) terminals of the alternating current power and the reverse polarity series type LED and/or a current-limiting impedance element (401) is series connected to LED (101) and/or a current-limiting impedance element (402) is series connected to the LED (102), and power storing and discharging device (301) and/or power storing and discharging device (302) is/are parallel-connected with the two ends of the diode (201) and/or diode (202), polarities during the delivery of alternating current power being such that they assume a power supply status with respect to the LED with which they are connected in parallel and when the power supply voltage is higher than the voltage of its parallel-connected power storing and discharging device, the power source simultaneously supplies power to the LED and charges the power storing and discharging device with which it is connected in parallel and the polarities of the alternating current power supply do not supply power to its parallel-connected LED and wherein when the power supply voltage is lower than the voltage of the power storing and discharging device, the power storing and discharging device will supply power to the LED with which it is connected in parallel by means of the operation of the power storing and discharging device, the following partial or complete functions are attained: 1) enables two LED's to deliver power and emit light without being affected by the polarity changes of the alternating current power source, 2) when alternating current power is driving the LED, optical pulsation of the LED is reduced 3) supplies delay electric energy for LED when power is cut off 4) serves as power supply to allow continuous lighting of LED's during an emergency power shutdown; the power storing and discharging device consisting of a rechargeable battery, a monopolar or bipolar capacitance, or a super capacitance.

7. The reverse polarity series type LED and drive circuit as claimed in claim 6 applied to an alternating current power source and connected in parallel to the power storing and discharging device, wherein the current-limiting impedance element (400) and/or the current-limiting impedance element (402) and/or current-limiting impedance element (402) is/are optionally installed.

8. The reverse polarity series type LED and drive circuit as claimed in claim 2 applied on the alternating current power, wherein a voltage-limiting element (501) and/or voltage-limiting element (502) is/are connected in parallel to both ends of diode (201) and/or diode (202) to form a voltage-limiting protection for the LED in conjunction with the installation of current-limiting impedance element (400) and/or current-limiting impedance element (401) and/or current-limiting impedance element (402), and wherein the voltage-limiting elements consist of zener diodes or electromechanical and electronic circuit devices with zener effects.

9. The reverse polarity series type LED and drive circuit as claimed in claim 2, wherein the two ends of the first LED and diode assembly and/or the second LED and diode assembly are further connected in parallel with the power storing and discharging device (301) and/or the power storing and discharging device (302), and also connected in parallel with voltage-limiting element (501) and/or voltage-limiting element (502), and wherein protection for the LED and power storing and discharging device is provided in conjunction with the installation of current-limiting element (400) and/or current-limiting element (401) and/or current-limiting element (402).

10. The reverse polarity series type LED and drive circuit as claimed in claim 2, wherein the specifications for power, voltages, currents and numbers as well as the series or parallel or series-parallel connections of LED (101) and LED (102) are the same as or different from each other and the colors of the lights emitted by the energized LED (101) and LED (102) are the same as or different from each other.

11. The reverse polarity series type LED and drive circuit as claimed in claim 4, 5, 6, 7 or 8, wherein the types and specifications of the current-limiting element (400) and/or current-limiting element (401) and/or current-limiting element (402) are the same as or different from each other; and the current-limiting impedance element (400) and/or the current-limiting impedance element (401) and/or the current-limiting impedance (402) is/are fixed impedances and adjustable impedance values or clipping controlled or linear controlled in order to control LED light adjustments and provide simultaneous or separate control of LED (101) and LED (102).

12. The reverse polarity series type LED and drive circuit as claimed in claim 6 or 8, wherein the types and specifications of the power storing and discharging device (301) and/or the power storing and discharging device (302) are the same as or different from each other.

13. The reverse polarity series type LED and drive circuit as claimed in claim 7 or 8, wherein the types and specifications of the voltage-limiting element (501) and/or voltage-limiting element (502) are the same with or different from each other.

* * * * *